United States Patent [19]

Bass

[11] Patent Number: 4,918,873

[45] Date of Patent: Apr. 24, 1990

[54] METHOD AND APPARATUS FOR REFURBISHING GOLF CLUBS

[76] Inventor: Donald R. Bass, 1341 Overlook Dove, Smyrna, Ga. 30080

[21] Appl. No.: 313,159

[22] Filed: Feb. 21, 1989

[51] Int. Cl.[5] ..... B24C 1/00; B24C 3/00

[52] U.S. Cl. ..... 51/281 R; 51/426; 51/424; 51/427

[58] Field of Search ..... 51/414, 426, 427, 424, 51/281 R; 15/21 A, 21 B, 21 C, 21 D, 310, 311, 345

[56] References Cited

U.S. PATENT DOCUMENTS

| | | | |
|---|---|---|---|
| 834,067 | 10/1906 | Hess | 51/426 |
| 2,576,008 | 11/1951 | Gladfelter et al. | 51/426 |
| 3,416,544 | 12/1968 | Paiva . | |
| 4,098,033 | 7/1978 | Mann | 51/426 |
| 4,433,698 | 2/1984 | Blaw | 134/56 R |
| 4,757,831 | 7/1988 | Ingermann et al. | 134/148 |

*Primary Examiner*—Frederick R. Schmidt
*Assistant Examiner*—Jack W. Levinder
*Attorney, Agent, or Firm*—Thomas & Kennedy

[57] ABSTRACT

Apparatus for refurbishing a golf club head has an enclosure in which a spray gun is located and a glove that is accessible from outside of the enclosure. A sealable club access channel is provided through which the golf club shaft may extend. The club head is refurbished with a stream of abrasive medium emitted by the gun as it is manipulated by manual movements of the club shaft or grip located outside the enclosure.

9 Claims, 2 Drawing Sheets

METHOD AND APPARATUS FOR REFURBISHING GOLF CLUBS

TECHNICAL FIELD

This invention relates to methods and apparatuses for refurbishing the heads of golf clubs with pressurized spray guns and the like.

BACKGROUND OF THE INVENTION

To insure accuracy of play, the heads of golf clubs should be kept as clean as possible. To this end players often carry towels for use in cleaning the club heads as required. Machines, such as that shown in U.S. Pat. No. 4,757,831, have also been devised for cleaning clubs at golf courses following rounds of play. These machines typically comprise a carousel in which clubs are routed past water spray nozzles which clean the club heads.

When golf clubs have been used for extended periods of time club head cleaning alone does not restore the club heads to a new or like new condition. This is because the surface of the heads have typically become stained, scratched or marred by objects on or beneath the surface of the terrain against which they strike or brush during play or scratched by typical handling. To refurbish the clubs their heads have usually been hand sanded with steel wool, sand paper or the like. This is a very tedious and time consuming task with only limited results in that the original luster is rarely achieved.

Spray chambers and cabinets have been devised for use in washing, cleaning and refurbishing other types of articles. Such have also been used in the manufacturing of golf club heads before club assembly. Exemplary of such cabinets are those shown in U.S. Pat. Nos. 3,416,544, 4,098,033, and 4,433,698. Commercial blasting chambers are also available from the Zero Manufacturing Company of Burlingame, Calif., from the A.L.C. Company of Medina, Ohio, from Infa, Inc. of Salisbury, N.C., and from Econoline Manufacturing Company of Grand Haven, Mich. These blast cabinets, however, are ill suited for use in refurbishing golf club heads. This is because of the fact that golf clubs are quite lengthy and thus would require an inordinately large chamber in which to be placed for blasting with sufficient room for the club head to be manually manipulated. Furthermore, only a small portion of the club, namely the head, exclusive of its hosel and ferrule, that should be subjected to the high pressure stream of abrasive material. Thus, the use of these type of commercially available cabinets would require that almost the entire club be carefully wrapped with protective material prior to being refurbished and that material later removed and discarded. This would be excessively time consuming and costly.

Accordingly, it is seen that a method and apparatus remains needed for use in refurbishing golf clubs. It is to the provision of such therefore that the present invention is primarily directed.

SUMMARY OF THE INVENTION

In a preferred form of the invention apparatus for refurbishing golf club heads comprises an enclosure and a glove mounted within the enclosure for insertion of a worker's hand from the enclosure exterior. Spray gun means are located within the enclosure which has a spray medium supply line which communicates with a medium supply source. The apparatus also has a sealable access channel provided in the enclosure through which the shaft of a golf club may extend from a golf club head located inside of the enclosure to a golf club grip located outside of the enclosure with minimal flow of the spray medium therethrough about the shaft. With this construction of the apparatus a golf club head may be manipulated by movement of the club shaft or grip outside of the enclosure and refurbished with the spray gun means operated by a gloved hand located inside the enclosure.

In another preferred form of the invention apparatus is provided for use in refurbishing a golf club with a spray gun or the like so as to restrict the flow of the spray medium. The apparatus comprises a base having a floor from which side walls upwardly extend and a lid adapted to be positioned on a top edge of a base side wall whereby the base and lid may jointly provide a substantially closed club refurbishing space. The apparatus also includes means for inserting and holding in substantial sealing engagement with one of the base side walls the shaft of a golf club with the club head located within the club refurbishing space and with the club grip located outside of the club refurbishing space. The club inserting and holding means comprises a slot formed in one of the base side walls so as to extend to the edge of that wall and resilient means for substantially sealing the slot with the shaft of a golf club extending therethrough.

In another form of the invention a method of refurbishing a golf club head comprises the steps of providing a refurbishing chamber, positioning the head of the club within the refurbishing chamber and the grip of the club outside of the chamber, and spraying the club head with an abrasive medium as the club head is manually manipulated by the club grip or that portion of the club shaft located outside of the chamber.

DETAILED DESCRIPTION

Figure 1:
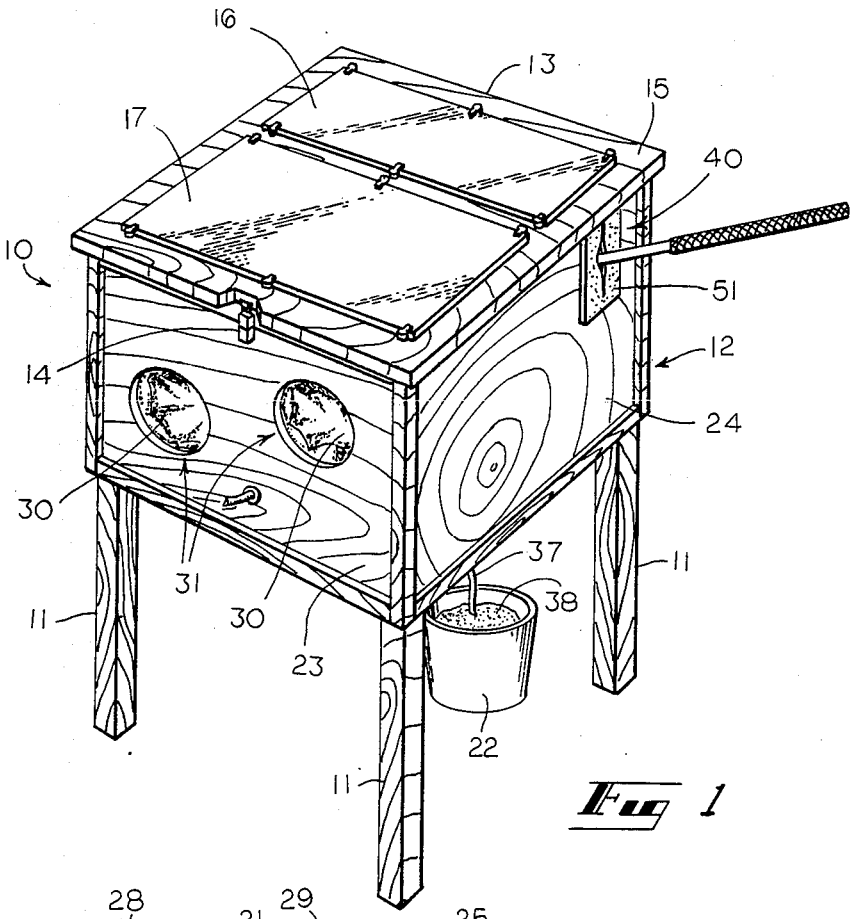
FIG. 1 is a perspective view of apparatus which embodies principles of the present invention and which may be used practicing the method of the present invention.

With reference next in more detail to the drawing, there is shown apparatus for use in refurbishing golf club heads which comprises an enclosure indicated generally at 10 which is mounted atop a set of legs 11. The enclosure is comprised primarily of an open top, box-like base 12 atop which a lid 13 is hinged for pivotal movement between a raised position allowing access to the interior of the base and the closed position shown in FIG. 1. The lid is held tightly and is sealed in its closed position by means of a latch 14. The lid here comprises a frame 15 which has two openings formed therein that are overlaid by two replaceable transparent, glass panels 16 and 17 that function as windows. A transparent deflector 18 is mounted to the lid to extend downwardly into the club refurbishing space or chamber bounded by the enclosure, as shown best in FIG. 3. If desired, the movable lid may cover only a portion of the top of the base. Also, it may close a side opening of the base instead of the top in which case the fixed top is provided with a clear glass window.

With continued reference to the drawing, the base 12 is seen to have a bottom or floor 20 which is downwardly tapered to a drain hole 21 beneath which a bucket 22 is located. Alternatively, a sump or canister may be employed instead of the bucket so that the floor of the unit is completely sealed. Four side walls 23–26 extend upwardly from the periphery of the floor 20 to a common rectangular upper rim 28 which is formed by the top edge of the side walls. A rectangular strip of resilient material, preferably an expanded polyurethane with structural memory, is mounted about an inboard portion of the rim. Similarly, another rectangular strip 29' of the same type of resilient material is mounted to the bottom of the lid 13 for direct contact with the outboard portion of the rim 28 snuggly about the strip 29 when the lid is closed. Two rubber gloves 30 are mounted to the inside of the base wall 23 about two holes 31 formed in that wall. This arrangement permits a worker's right or left hand to be inserted from the outside of the enclosure into a glove located within the work chamber without the worker's hand being exposed to the internal environment of the enclosure and thus to abrasive medium sprayed onto the club heads.

A conventional spray gun 35 is movably located within the enclosure from which a compressed air line 36 extends through a sealed fitting within an access hole formed in the wall 23 to a source of compressed air. An abrasive medium supply line 37 also extends from the gun 35 down through the drain hole 21 and into the bucket 22 and into a supply of abrasive medium 38 located within the bucket.

The apparatus also has a sealable access channel indicated generally at 40 formed in the side wall 24 and a flexible vent tube 42 that extends from a hole in the opposite side wall 26. That hole is overlaid by a louver assembly 43 mounted on the inside of the wall 26. The sealable access channel 40 comprises an elongated slot which extends downwardly from the rim 28 of the base 12 such as, for example, for a distance of some four inches. The width of this slot is somewhat larger than the diameter of a conventional golf club shaft so as to enable the shaft to be moved about and to assume different lateral spraying angles of transit through the slot.

Figure 4:
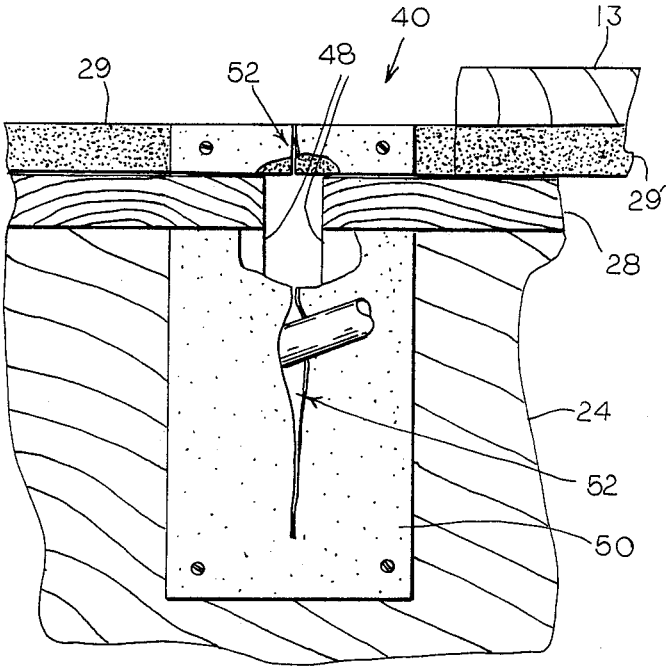
FIG. 4 is an enlarged, external view of the sealable club access channel component of the apparatus of FIG. 1.
Figure 5:
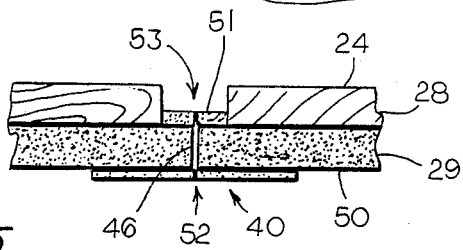
FIG. 5 is an enlarged plan view of the sealable club access channel illustrated in FIG. 4.

The strip of resilient material 29 mounted atop the rim 28 is provided with a slit 46 in alignment with the slot formed in wall 24, as best shown in FIG. 5. The two side walls 48 of the slot are shown in FIG. 4. A strip 51 of resilient material such as rubber is mounted to the exterior of the side wall 24 to overlay the outside of the slot. Similarly, another strip of material 50 is mounted to the inside surface of the side wall 24 to overlay the inside of the slot. The strips of material 50, 51 are formed with slits 52 and 53, respectively, in alignment with the slit 46 in the strip 29 as well as with the slot. To accommodate for the fact that a golf club will normally held at an incline of some 15 to 30 degrees, with the club head located below the club grip, the bottom of the slit 52 is preferably located slightly above the bottom of the slot while the bottom of the slit 53 is preferably located approximately at the height of the slot bottom.

The apparatus may be easily and effectively used in refurbishing a golf club of the type illustrated which conventionally has a club head 60 from which a shaft 61 extends to a handle or grip 62. To refurbish the head 60 so as to avoid abrasing the hosel, ferrule and an adjacent portion of the shaft, these components of the club are covered with protective tape. The enclosure lid 13 is raised whereupon the top of the club access channel 40 becomes accessible for shaft insertion. The club shaft is then pressed downwardly into the access channel 40. As this is done the shaft moves into the slits 46, 52 and 53 thereby causing them to spread in accepting the shaft with the slit 46 fully reclosing after shaft passage. The shaft is preferably moved downwardly until it contacts the slot bottom whereupon the bottom may then serve as a fulcrum in manipulating the club.

With the shaft 61 now located in the access channel the lid 13 is closed and held snuggly to the base by the latch 14. In doing this the strip of material 29' mounted to the bottom of the lid, which need not be slitted, covers the outboard portion of the rim 28 and the top of the slot exit at the rim. The strip of material 29 mounted to the inboard portion of the rim is reclosed by the inherent resiliency of the material that bounds the slit 46. Also, the slits 52 and 53 in the inboard and outboard strips close upon the shaft by the inherent resiliency of their material structures. These slits do not make a total seal about the shaft but leave a very small gap above and below the shaft, which for purposes of illustration are shown exaggerated in FIG. 4. However, due to the fact that these gaps are actually very small, and are normally out of alignment with each other due to the incline of the club shaft, minimal abrasive blasting medium passes through these gaps during refurbishing operations.

Figure 2:
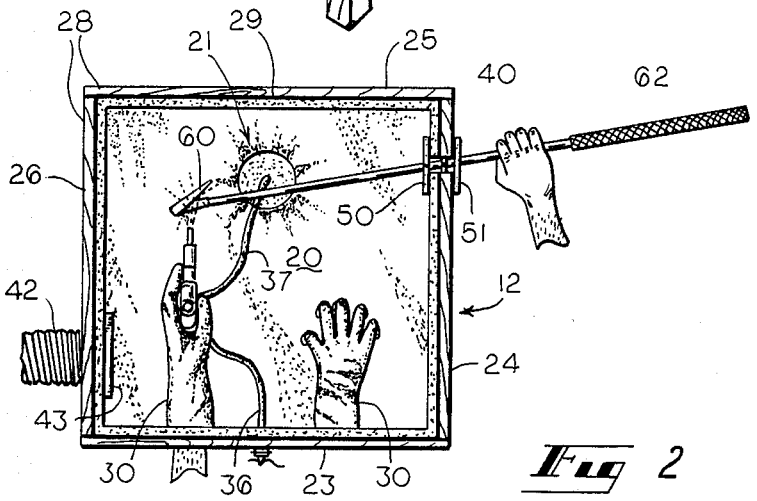
FIG. 2 is a plan view of the apparatus illustrated in FIG. 1 with its lid removed to reveal a club head being refurbished within the apparatus.
Figure 3:
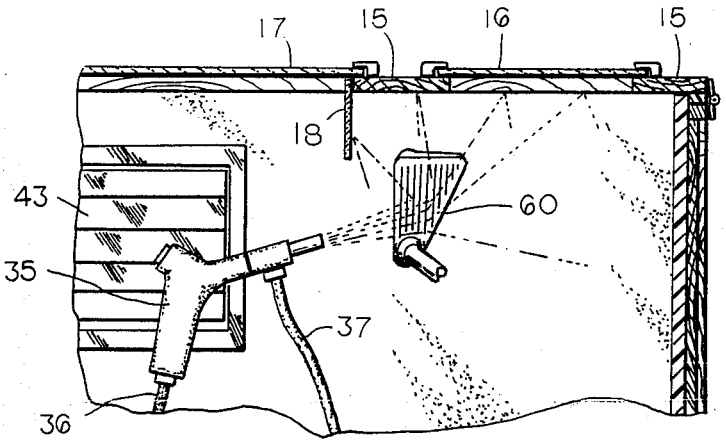
FIG. 3 is a cross-sectional view of a portion of the apparatus showing a pattern of spray being directed onto and splattering from the face of a golf club head being refurbished.

With the club head now maneuverably and substantially sealably located within the enclosure, a worker may insert his left hand into the left hand glove, as specifically illustrated in FIG. 2, and grip the blast gun 35 and with his other hand grip the club shaft or handle located exteriorally of the enclosure. The club head is then blasted with the abrasive medium by actuating the gun trigger whereupon a high velocity stream of abrasive material is directed against the club face, top and sides of the club head 60 as best shown in FIGS. 2 and 3. As this is done the worker observes the refurbishing operation through the lid panel 17 which is dept relatively clear of the abrasive material by means of the deflector 18 therefore keeping the front sight glass clear. Abrasive material is splattered by the club head onto the base walls, bottom and the lid to gravitate down to the bottom and drain through the drain hole 21 into the bucket 22. The abrasive material 38 in the bucket, collected as it passes down through the drain hole 21, is used to resupply the gun 35 through the supply line 37. Thus, the abrasive material that is sprayed in the enclosure is recirculated continuously from the collection bucket.

During refurbishing the club head may be easily manipulated by manually twisting the shaft portion located outside of the enclosure as well as pivoting it upon the fulcrum provided by the bottom of the slot of the access channel. At the same time the club head is blasted with abrasive medium sprayed from the spray gun which is also mobile. In this manner the spray stream may easily be directed onto all sides of the head. Finally, to complete an operation the spray gun trigger is released, the lid unlatched and opened, the club lifted out of the enclosure base and access channel, and the protective tape removed.

It thus is seen that a method and apparatus for refurbishing golf clubs is now provided which overcomes limitations of those of the prior art. It should be understood, however, that the just described embodiment merely illustrates principles of the invention in a preferred form. Many modifications, additions and deletions may be made thereto without departure from the spirit and scope of the invention as set forth in the following claims.

I claim:

1. Apparatus for refurbishing gold club heads comprising an enclosure which has a top, a bottom and sides; a glove mounted within said enclosure for insertion of a hand of an operator from the exterior of said enclosure; spray gun means located within said enclosure movable about the interior of said enclosure by a gloved hand for spraying an abrasive spray medium and which has an abrasive spray medium supply line communicating with a medium supply source; and a sealable access channel provided on said enclosure which comprises a slot formed in one of said enclosure sides that extends to a slot entry at the top edge of said side through which the shaft of a golf club may extend from a club head located inside of said enclosure to a club grip located outside of said enclosure without substantial flow of spray medium therethrough, whereby a club head may be manipulated by movement of the club shaft or grip outside of the enclosure while the club head is refurbished with the spray gun means operated by a gloved hand within the enclosure.

2. The apparatus of claim 1 wherein said enclosure comprises a base having a bottom from which side walls upwardly extend, and a lid mounted for movement between an open position providing access to the interior of said enclosure and a closed position upon said base.

3. The apparatus of claim 1 wherein said sealable access channel further comprises a pair of resilient strips of material mounted to the interior and exterior of said enclosure side overlaying said slot, and wherein each of said strips is formed with a slit aligned with said slot in which the club shaft may be extended downwardly and seated on the bottom of said slot.

4. The apparatus of claim 3 further comprising a strip of resilient material mounted on said lid in a position to overlay said slot entry in said base side top edge.

5. The apparatus of claim further comprising a deflector mounted to said lid so as to extend downwardly therefrom with said lid in said closed position between said glove and said access channel.

6. Apparatus for use in refurbishing golf club heads with a spray gun or the like and with the apparatus comprising a base having a floor from which side walls upwardly extend; a lid adapted to be positioned on an edge of at least one of said base side walls whereby said base and lid jointly: bound a substantially enclosed club refurbishing space, and means for inserting and holding in sealing engagement with one of said base side walls the shaft of a golf club with the club head located within the club refurbishing space and with the club grip located outside of the club cleaning space, and with said inserting and holding means comprising a slot formed in said one side wall that extends to a slot entry at the top of said one side wall edge and resilient means for substantially sealing said slot with the shaft of a golf club extending therethrough.

7. The apparatus of claim 6 wherein said resilient sealing means comprises a pair of slit strips of rubber or rubber-like material mounted to opposite sides of said one side wall with their slits aligned with said slot.

8. The apparatus of claim 6 wherein said resilient sealing means comprises a strip of resilient material mounted to said one side wall edge or to said lid to overlay the open end of said slot along said one side wall edge.

9. The method of refurbishing a golf club head which comprises the steps of providing a refurbishing chamber, positioning the head of the club within the refurbishing chamber and the grip of the club outside of the chamber, and spraying the club head with an abrasive medium as the club head is manually manipulated by the club grip or that portion of the club shaft located outside of the chamber wherein a refurbishing chamber is provided of the type that has an open top case formed with a self sealing slot that extends to a slot entry at the upper rim of the base and a repositionable lid, and wherein the head of the club is positioned within the refurbishing chamber by passing the club shaft down through the slot entry and into the self sealing slot from the upper rim with the lid lifted from the base rim.

* * * * *